US010221514B2

(12) United States Patent
Song et al.

(10) Patent No.: US 10,221,514 B2
(45) Date of Patent: Mar. 5, 2019

(54) CLOTHES TREATING APPARATUS

(71) Applicant: LG ELECTRONICS INC., Seoul (KR)

(72) Inventors: Sungho Song, Seoul (KR); Sungmin Ye, Seoul (KR); Jongseok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 155 days.

(21) Appl. No.: 15/152,658

(22) Filed: May 12, 2016

(65) Prior Publication Data

US 2016/0355968 A1 Dec. 8, 2016

(30) Foreign Application Priority Data

Jun. 2, 2015 (KR) ..... 10-2015-0078076

(51) Int. Cl.
*D06F 39/08* (2006.01)
*D06F 39/00* (2006.01)
(Continued)

(52) U.S. Cl.
CPC ..... *D06F 39/008* (2013.01); *D06F 39/022* (2013.01); *D06F 58/203* (2013.01); *D06F 58/10* (2013.01)

(58) Field of Classification Search
CPC ..... D06F 58/10; D06F 58/14; D06F 58/20; D06F 58/203; D06F 73/00; D06F 73/02;
(Continued)

(56) References Cited

U.S. PATENT DOCUMENTS 2,602,004 A * 7/1952 Faktor ..... B05B 7/0815 239/301
2,616,761 A 11/1952 Miller
2013/0117944 A1* 5/2013 Moon ..... D06F 73/02 8/137

FOREIGN PATENT DOCUMENTS

CN 2491479 Y 5/2002
CN 102405315 4/2012
(Continued)

OTHER PUBLICATIONS

Machine Translation of Koch et al., WO 2010/145869, Dec. 2010. (Year: 2010).*
(Continued)

*Primary Examiner* — David G Cormier
(74) *Attorney, Agent, or Firm* — Fish & Richardson P.C.

(57) ABSTRACT

The present invention relates to a clothes treating apparatus, which includes a cabinet, a steam generator to generate steam, a solution storing container in which a functional solution for recovering a function of the clothes is stored, and a spray unit provided with a steam spraying portion connected to the steam generator to spray steam, and a solution spraying portion connected to the solution storing container to spray the functional solution within the solution storing container, in response to the steam being sprayed through the steam spraying portion, wherein the spray unit allows the functional solution sprayed through the solution spraying portion to be sprayed in a manner of being mixed with the steam sprayed through the steam spraying portion, whereby the use of a pump can be excluded and thus a generation of noise caused due to the pump during spraying of the functional solution can be prevented.

15 Claims, 6 Drawing Sheets

(51) Int. Cl.

| | |
|---|---|
| ***D06F 58/20*** | (2006.01) |
| ***D06F 39/02*** | (2006.01) |
| *D06F 58/10* | (2006.01) |

(58) Field of Classification Search

CPC ..... D06F 39/008; D06F 39/022; D06F 87/00; D06F 43/002; B05B 7/0416; B05B 7/06; B05B 7/062; B05B 7/066; B05B 7/0807; B05B 7/0815; B05B 7/0861

See application file for complete search history.

(56) References Cited

FOREIGN PATENT DOCUMENTS

| | | |
|---|---|---|
| CN | 102656313 | 9/2012 |
| CN | 102725446 | 10/2012 |
| DE | 3408136 | 9/1985 |
| EP | 2213779 | 8/2010 |
| JP | H04189400 | 7/1992 |
| JP | 07-059278 | 6/1995 |
| KR | 10-2012-0074557 | 7/2012 |
| KR | 10-2014-0108455 | 9/2014 |
| WO | 10/145869 | 12/2010 |
| WO | 2012/013539 | 2/2012 |

OTHER PUBLICATIONS

Machine Translation of JP 07-059278, Jun. 1995. (Year: 1995).*

International Search Report and Written Opinion in International Application No. PCT/KR2016/004609, dated Aug. 4, 2016, 13 pages.

European Search Report in European Application No. 16168051.7, dated Oct. 4, 2016, 9 pages.

Chinese Office Action in Chinese Application No. 201610387814.4, dated Dec. 27, 2017, 16 pages (with partial English translation).

* cited by examiner

CLOTHES TREATING APPARATUS

CROSS-REFERENCE TO RELATED APPLICATION

Pursuant to 35 U.S.C. § 119(a), this application claims the benefit of an earlier filing date of and the right of priority to Korean Application No. 10-2015-0078076, filed on Jun. 2, 2015, the contents of which are incorporated by reference herein in its entirety.

BACKGROUND OF THE INVENTION

1. Field of the Invention

The present disclosure relates to a clothes treating apparatus, and more particularly, a clothes treating apparatus capable of excluding a use of a pump for spraying a functional solution.

2. Background of the Invention

As well known, a clothes treating apparatus includes a washing machine washing clothes or laundry, a drying machine drying clothes, a washing/driving machine having washing and drying functions, and a refresher or a clothes management device refreshing clothes by supplying hot air to the clothes.

The drying machine includes a drum type drying machine that dries clothes in a spinning manner, and a so-called cabinet type drying machine that dries clothes while hanging the clothes.

Some of such clothes treating apparatuses, such as the drying machine, the washing/drying machine, the refresher and the clothes managing device, having the drying function, are provided with a spraying device or a spray unit that sprays a functional solution for restoring functionalities of clothes to be treated, for example, a wrinkle removal, a deodorization, a clothes shape recovery, a clothes lifespan expansion, and the like.

The spraying device of spraying the functional solution includes a spray nozzle for spraying the functional solution, and a pump for pumping the functional solution into the spray nozzle.

However, in the related art clothes treating apparatus which employs the pump for pumping the functional solution, a cost for employing the pump is added and fabricating costs are increased accordingly.

Also, during an operation of the pump, relatively loud noise is generated.

The spray nozzle for spraying the functional solution has a narrow spray range, which causes difficulty in uniformly spraying the solution onto the entire clothes.

Accordingly, a portion of the clothes on which the functional solution is not sprayed is generated, and thereby makes it difficult to achieve the purpose of using the functional solution.

The narrow spray range of the spray nozzle of the functional solution causes an increase in a number of spray nozzles, thereby increasing the fabricating costs.

Also, the increase in the number of spray nozzles more frequently causes a problem that the spray nozzles are blocked, which may result in lowering operation efficiency of the clothes treating apparatus.

SUMMARY OF THE INVENTION

Therefore, to obviate those problems, an aspect of the detailed description is to provide a clothes treating apparatus capable of preventing a generation of noise caused due to an operation of a pump during spraying of a functional solution, in a manner of excluding a use of the pump.

Another aspect of the detailed description is to provide a clothes treating apparatus capable of reducing a component cost for spraying a functional solution in a manner of excluding a use of a pump.

Another aspect of the detailed description is to provide a clothes treating apparatus capable of uniformly spraying a functional solution to clothes to be treated.

Another aspect of the detailed description is to provide a clothes treating apparatus capable of preventing a nozzle for spraying a functional solution from being blocked.

To achieve these and other advantages and in accordance with the purpose of this specification, as embodied and broadly described herein, there is provided a clothes treating apparatus, including a cabinet having an accommodating space for accommodating clothes to be treated therein, a steam generator to generate steam, a solution storing container in which a functional solution is stored, the functional solution being applied to the clothes to be treated to recover a function of the clothes, and a spray unit provided with a steam spraying portion connected to the steam generator to spray steam, and a solution spraying portion connected to the solution storing container to spray the functional solution within the solution storing container, in response to the steam being sprayed through the steam spraying portion, wherein the spray unit allows the functional solution sprayed through the solution spraying portion to be sprayed in a manner of being mixed with the steam sprayed through the steam spraying portion.

In an exemplary embodiment, the apparatus may further include a communication pipe having one end portion communicating with the steam generator and another end portion communicating with the solution storing container. The solution storing container may be configured such that internal pressure thereof is increased by the communication pipe while generating the steam in the steam generator.

In an exemplary embodiment, the apparatus may further include a steam pipe connecting the steam generator and the steam spraying portion to each other, and the communication pipe may be connected to the steam pipe.

In an exemplary embodiment, the steam spraying portion may have a spraying speed at which the sprayed steam atomizes the functional solution sprayed through the solution spraying portion.

In an exemplary embodiment, the steam spraying portion may be disposed at an outer side of the solution spraying portion.

A guide may protrude from an outer side of an outlet of the steam spraying portion in a spraying direction of the solution spraying portion to be higher than an outlet of the steam spraying portion.

In an exemplary embodiment, the steam spraying portion may have a spraying direction of the steam intersecting with a spraying direction of the functional solution of the solution spraying portion.

In an exemplary embodiment, the spraying direction of the steam through the steam spraying portion may be inclined by 40° to 60° with respect to the spraying direction of the functional solution through the solution spraying portion.

In an exemplary embodiment, an outlet of the solution spraying portion may protrude more than an outlet of the steam spraying portion along a spraying direction of the functional solution.

In an exemplary embodiment, the steam spraying portion may have an inner diameter expanded more than that of the solution spraying portion and concentrically disposed at an outer side of the solution spraying portion.

In an exemplary embodiment, the solution spraying portion may have a diameter in the range of 1.5 mm to 2.5 mm.

In an exemplary embodiment, the spray unit may include a annular spraying portion having an annular shape and disposed at an outer side of the solution spraying portion.

In an exemplary embodiment, the spray unit may include a plurality of arcuate spraying portions each having an arcuate shape and disposed at an outer side of the solution spraying portion.

In an exemplary embodiment, the spray unit may include a plurality of linear spraying portions each having a linear shape and disposed at an outer side of the solution spraying portion.

In an exemplary embodiment, the steam spraying portion may have an arcuate shape and be disposed at an outer side of the solution spraying portion.

In an exemplary embodiment, the steam spraying portion may have a linear shape and be disposed at an outer side of the solution spraying portion.

In an exemplary embodiment, the apparatus may further include a switching valve to open and close the communication pipe, a mode selecting unit to select a solution supply mode for supplying the functional solution to the clothes to be treated, and a controller to control the switching valve to be open when the solution supply mode is selected by the mode selecting unit.

In an exemplary embodiment, a machine room may be provided at a lower side of the accommodating space within the cabinet. An air outlet through which air is discharged out and an air inlet through which air is introduced may be provided at the accommodating space. The machine room may include therein an air supply device which is connected to the air outlet and the air inlet and by which the air within the accommodating space is discharged, processed and supplied through the air inlet.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

DETAILED DESCRIPTION OF THE INVENTION

Hereinafter, a clothes treating apparatus according to the present invention will be described in more detail with reference to the accompanying drawings. For the sake of brief description with reference to the drawings, the same or equivalent components may be provided with the same or similar reference numbers, and description thereof will not be repeated. A singular representation may include a plural representation unless it represents a definitely different meaning from the context.

The present invention relates to a clothes treating apparatus capable of excluding the use of a pump for spraying a functional solution.

Figure 1:
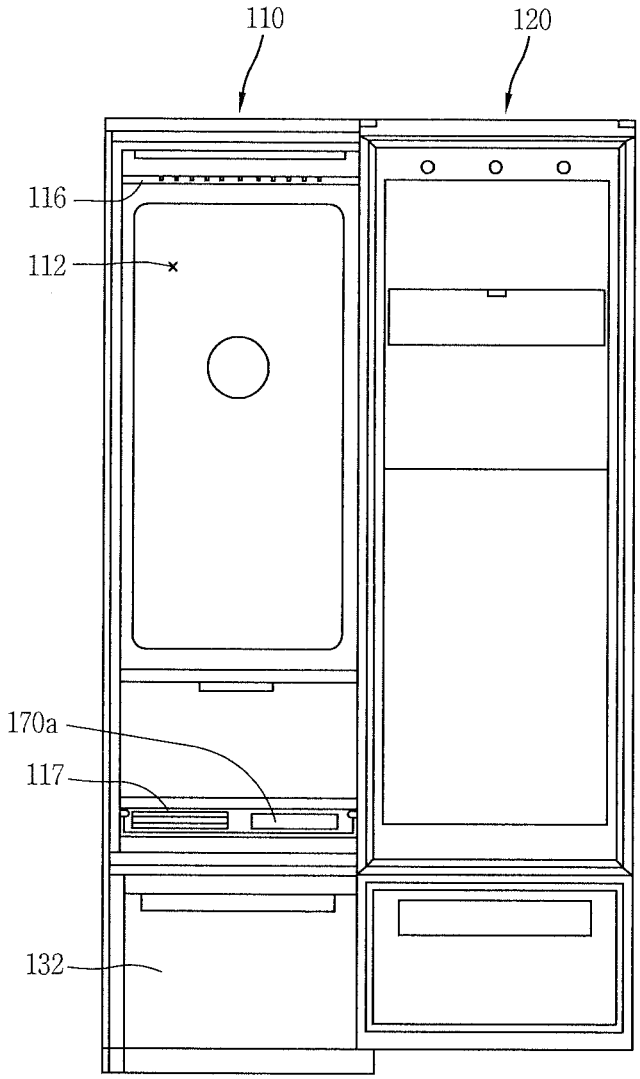
FIG. 1 is a view illustrating an inside of a clothes treating apparatus in accordance with one exemplary embodiment of the present invention.
Figure 2:
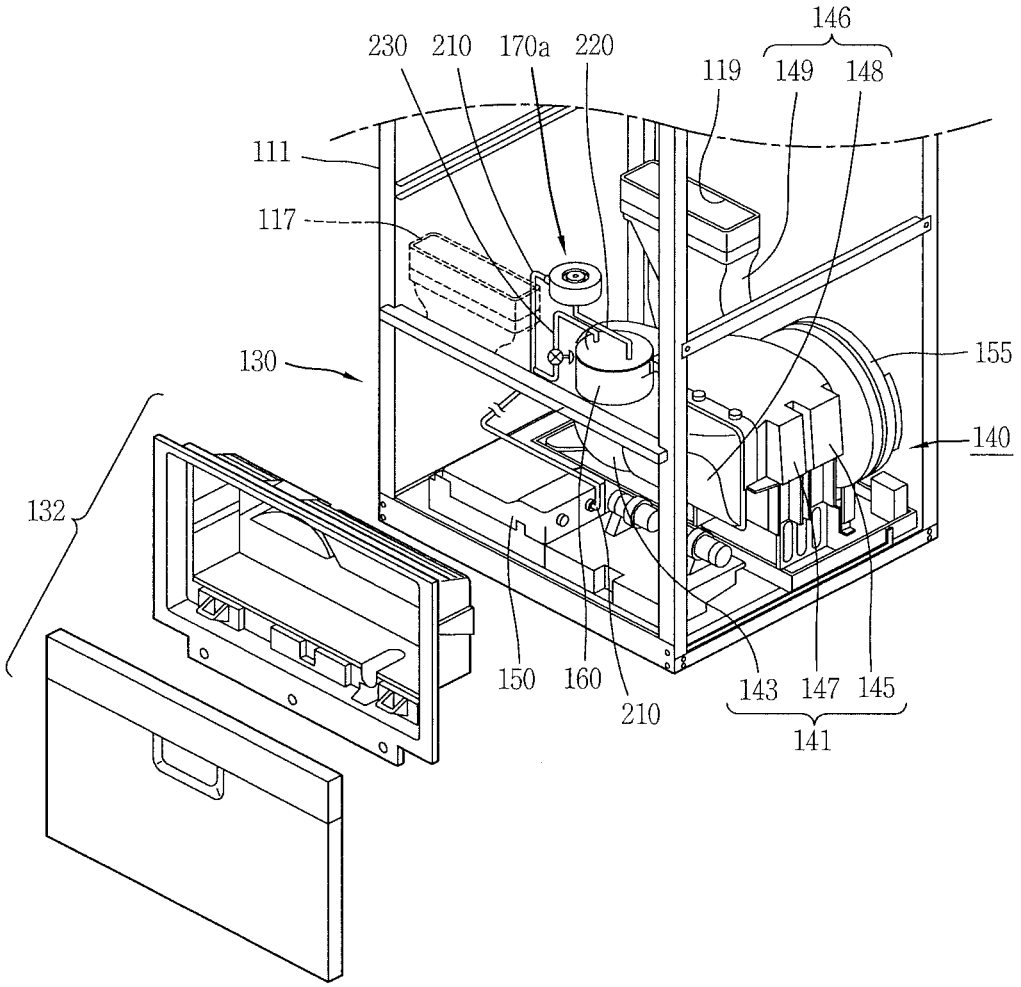
FIG. 2 is a disassembled perspective view of a main part of the clothes treating apparatus illustrated in FIG. 1.

FIG. 1 is a view illustrating an inside of a clothes treating apparatus in accordance with one exemplary embodiment of the present invention, and FIG. 2 is a disassembled perspective view of a main part of the clothes treating apparatus illustrated in FIG. 1. As illustrated in FIGS. 1 and 2, the clothes treating apparatus according to the one exemplary embodiment of the present invention may include a cabinet 110 having an accommodating space 112 in which clothes to be treated is accommodated, a steam generator 150 for generating steam, a solution storing container 160 for storing therein a functional solution which is applied to the clothes to be treated such that a function of the clothes can be recovered, a spray unit 170*a* provided with a steam spraying portion 180 connected to the steam generator 150 to spray steam, and a solution spraying portion 190 connected to the solution storing container 160 to spray the functional solution, a steam pipe 210 through which the steam generator 150 and the steam spraying portion 180 are connected to each other, a solution pipe 220 through which the solution storing container 160 and the solution spraying portion 190 are connected to each other, and a communication pipe 230 having one end portion connected to the steam generator 150 or the steam pipe 210 and another end portion communicating with an inside of the solution storing container 160. The spray unit 170*a* may be configured in a manner that the functional solution which is sprayed through the solution spraying portion 190 can be sprayed by being mixed with the steam which is sprayed through the steam spraying portion 180.

Here, the functional solution refers to a liquid material containing an element which allows a recovery of a functionality of the clothes to be treated, for example, provides at least one of effects, such as a deodorization, a wrinkle removal, a clothes shape recovery and a clothes lifespan expansion.

The cabinet 110, for example, may be provided with an accommodating space 112 with a front opening through which clothes to be treated is introduced into the accommodating space 112.

The cabinet 110 may have an approximately rectangular parallelepiped shape and frames 111 may be provided on edges of the cabinet 110, respectively.

The cabinet 110 may be provided with a door 120 that is rotatable centering on hinges installed at one side thereof so as to open and close the opening.

The accommodating space 112, for example, may include a supporting rod 116 which is formed at an upper area within the cabinet 110 and on which clothes to be treated is hung.

The supporting rod 116, for example, may also be provided with a movable supporting rod (not illustrated), which is a so-called 'moving hanger' applying a predetermined motion to the clothes to be treated while the clothes to be treated is supported.

The accommodating space 112, for example, may include therein the spray unit 170*a* by which steam and/or a functional solution can be sprayed into the accommodating space 112.

This exemplary embodiment illustrates that the spray unit 170*a* is configured as a single unit and disposed at a lower area within the accommodating space 112. However, this is merely illustrative, and a number and an installation position of the spray unit 170*a* may be appropriately adjusted.

The accommodating space 112 may be provided with an air outlet 117 through which internal air is discharged to outside, and an air inlet 119 through which the discharged air is introduced back into the accommodating space 112.

A machine room 130 in which driving components are disposed may be provided, for example, below the accommodating space 112.

The machine room 130 may include an air supply device 140 which supplies air into the accommodating space 112, in a manner of removing moisture in the air or heating the air.

The air supply device 140, for example, may include a so-called heat pump 141, which includes a compressor 143 compressing a refrigerant, a condenser 145 condensing the refrigerant in a radiating manner, an expansion device expanding the refrigerant, and an evaporator 147 by which the refrigerant is evaporated by absorbing latent heat.

The air supply device 140, for example, may include a circulation passage 146 through which the air within the accommodating space 112 circulates via the machine room 130.

The circulation passage 146, for example, may include a discharge duct 148 having one side connected to the air outlet 117, and an introduction duct 149 connected to the air inlet 119, and a fan 155 facilitating a flow of air.

In the circulation passage 146 may be disposed the evaporator 147 for cooling air discharged out of the accommodating space 112.

Accordingly, the air discharged out of the accommodating space 112 may be cooled down below dew-point temperature, and thus moisture in the air may be condensed and removed from the air.

Also, in the circulation passage 146 may be provided with the condenser 145 which heats the air discharged out of the accommodating space 112.

The condenser 145, for example, may be disposed at a downstream side of the evaporator 147 in a flowing direction of the air discharged out of the accommodating space 112.

As a result, after the air discharged out of the accommodating space 112 is cooled by the evaporator 147 and moisture within the air is removed accordingly, the air may be heated by the condenser 145 to higher temperature.

With the configuration, when the fan 155 starts to rotate, air within the accommodating space 112 is discharged through the air outlet 117. Moisture is removed from the discharged air and temperature of the air discharged air is raised while the air flows along the circulation passage 146. Afterwards, the air flows along the introduction duct 149 and then is introduced back into the accommodating space 112 through the air inlet 119. These processes are repeatedly performed.

This exemplary embodiment illustrates that the fan 155 is disposed at the downstream side of the condenser 145, but the position of the fan 155 may be adjustable.

The spray unit 170*a* for spraying steam and/or a functional solution into the accommodating space 112 may be provided in the accommodating space 112.

A steam generator 150 generating steam may be provided within the machine room 130.

A door module 132 may be detachably provided on a front area of the machine room 130. The door module 132, although not illustrated in detail, may be provided with a water supply unit supplying water into the steam generator 150.

A solution storing container 160 in which the functional solution is stored may be provided at another side of the machine room 130, for example.

Figure 3:
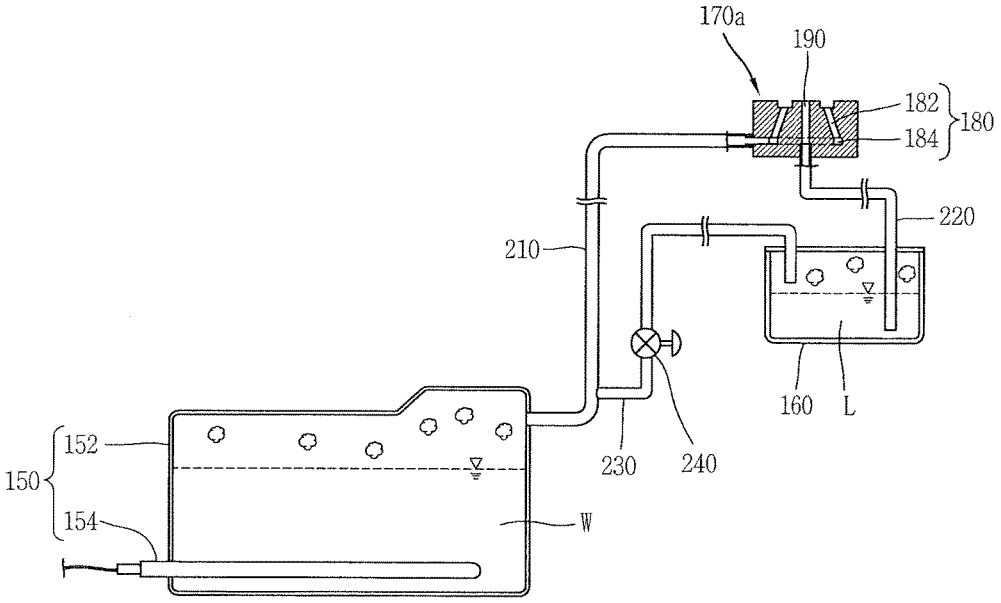
FIG. 3 is a view illustrating a steam generator, a solution storing container and a spray unit of FIG. 2.
Figure 4:
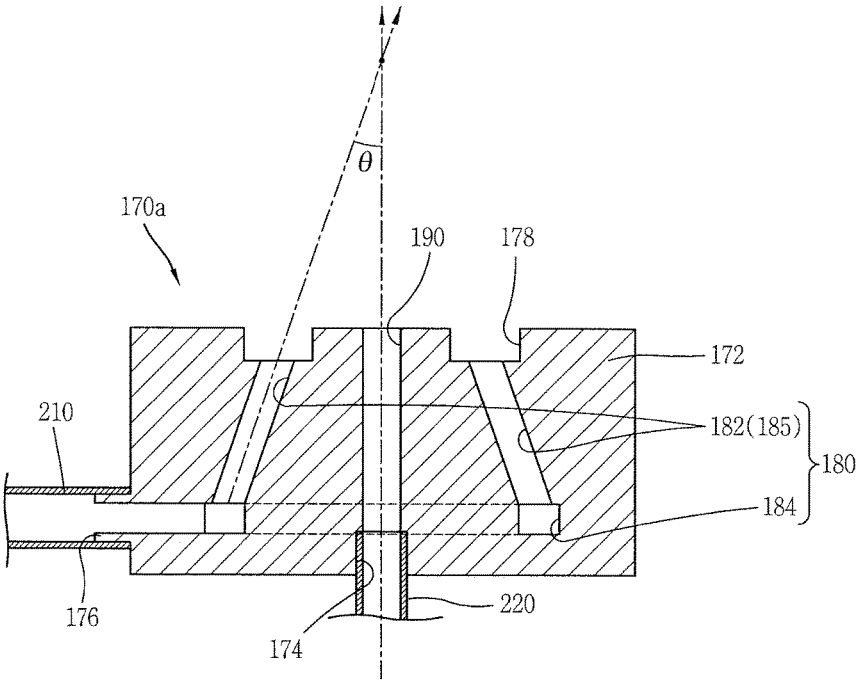
FIG. 4 is an enlarged view of the spray unit of FIG. 3.
Figure 5:
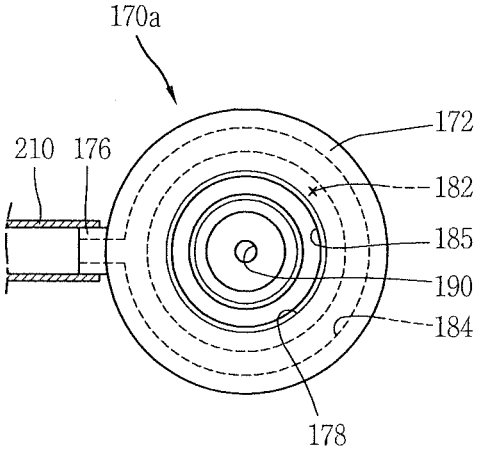
FIG. 5 is a planar view of the spray unit of FIG. 4.

FIG. 3 is a view illustrating a steam generator, a solution storing container and a spray unit of FIG. 2, FIG. 4 is an enlarged view of the spray unit of FIG. 3, and FIG. 5 is a planar view of the spray unit of FIG. 4.

As illustrated in FIG. 3, the steam generator 150 may include a container 152 having a steam generating space therein, and an electric heater 154 disposed within the container 152 and generating steam by heating water when power is applied.

The solution storing container 160 may be formed in a shape of a tub in which the functional solution can be stored.

Here, the container 152 of the steam generator 150 and the solution storing container 160, for example, may be configured to tolerate internal pressure until it reaches preset pressure while generating the steam.

One end portion of the solution pipe 220 may be inserted into the solution storing container 160 such that the functional solution in the solution storing container 160 can be discharged outward therethrough.

The solution pipe 220, for example, may be installed in a manner that one end portion thereof is adjacent to an internal lower area of the solution storing container 160.

A collecting portion 162 which has a more reduced cross section than that of the solution storing container 160 so as to collect the functional solution may be formed at a lower portion of the solution storing container 160.

This may facilitate the discharge of the functional solution within the solution storing container 160.

Meanwhile, the spray unit 170*a*, for example, as illustrated in FIG. 4, may include a steam spraying portion 180 through which steam is sprayed, and a solution spraying portion 190 through which the functional solution is sprayed.

The spray unit 170*a* may include a body 172 in a disk-like shape, the solution spraying portion 190 formed at a center of the body 172, and the steam spraying portion 180 formed at an outer side of the solution spraying portion 190.

The solution spraying portion 190 may be formed in a manner of penetrating through the body 172.

The solution spraying portion 190 may have a diameter in the range of 1.5 mm to 2.5 mm.

This may prevent the solution spraying portion 190 from being blocked.

The body 172 of the spray unit 170*a*, for example, may be provided with a solution pipe coupling portion 174 to which another end portion of the solution pipe 220 whose one end portion is connected to the solution storing container 160 is coupled.

The solution pipe coupling portion 174, for example, may be upwardly recessed from a lower surface of the body 172.

Accordingly, an end portion of the solution pipe 220 may be coupled in a manner of being inserted into the solution pipe coupling portion 174 by a predetermined depth.

The steam spraying portion 180 may be disposed at the outer side of the solution spraying portion 190.

In more detail, as illustrated in FIG. 5, the steam spraying portion 180 may have a more expanded inner diameter than that of the solution spraying portion 190 and be disposed concentric with the solution spraying portion 190.

The steam spraying portion 180 may be configured such that the functional solution discharged through the solution spraying portion 190 can be sprayed at speed which allows atomization of the functional solution.

An outlet of the solution spraying portion 190 may protrude more than an outlet of the steam spraying portion 180 along the spraying direction of the solution. The spraying direction of the steam may intersect with the spraying direction of the solution of the solution spraying portion 190.

In more detail, for example, the steam spraying portion 180 may be disposed in a manner that the spraying direction of the steam is inclined by 40° to 60° with respect to the spraying direction of the solution of the solution spraying portion 190.

With the configuration, the functional solution can be atomized by the steam, which is sprayed through the steam spraying portion 180 at a preset speed, before being brought into contact with the clothes.

A guide 178 may protrude along an outer side of the outlet of the steam spraying portion 180 in the spraying direction of the solution spraying portion 190.

Accordingly, the steam sprayed through the steam spraying portion 180 can be prevented from be unnecessarily sprayed outwardly along a radial direction.

With the configuration, the functional solution may be atomized by colliding with the steam sprayed from the steam spraying portion 180. The atomized functional solution may be mixed with the sprayed steam so as to be spread to the clothes to be treated. This may allow the functional solution to be uniformly brought into contact with a relatively wide area of the clothes to be treated.

This may result in facilitation of achieving the purpose (e.g., deodorization, wrinkle removal, clothes shape recovery, lifespan extension, etc.) of the functional solution.

The body 172 of the spray unit 170*a*, for example, may be provided with a steam pipe coupling portion 176 to which another end of the steam pipe 210 having the one end connected to the steam generator 150 is coupled.

The steam pipe coupling portion 176, for example, may protrude outwardly from one side of the body 172 of the spray unit 170*a*.

The steam spraying portion 180, for example, may include a tilt section 182 which is disposed inclined with respect to the spraying direction of the solution of the solution spraying portion 190, and a connection section 184 at which the steam pipe coupling portion 176 and the tilt section 182 are connected to each other.

The tilt section 182, for example, may include an annular spraying portion 185.

The annular spraying portion 185, for example, may have an annular shape.

Figure 6:
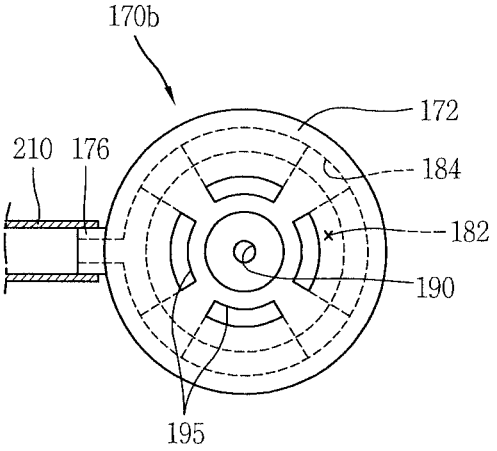
FIG. 6 is a planar view illustrating a variation of the spray unit of FIG. 3.
Figure 7:
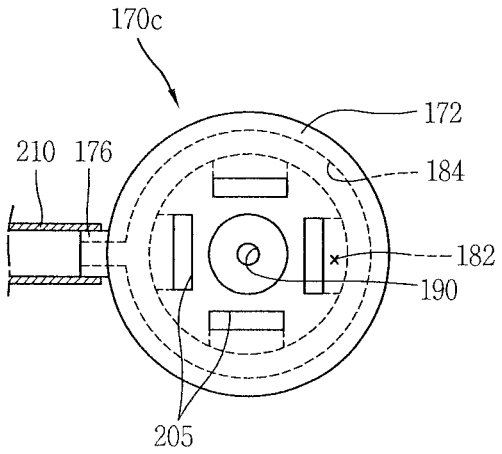
FIG. 7 is a planar view illustrating a variation of the spray unit of FIG. 3.

Meanwhile, FIGS. 6 and 7 are planar views of variations of the spray unit of FIG. 3, respectively.

First, as illustrated in FIG. 6, a spray unit 170*b* may include a plurality of arcuate spraying portions 195 provided at the tilt section 182 of the steam spraying portion 180.

Each of the arcuate spraying portions 195, for example, may be disposed at an outer side forming a concentric circle with the solution spraying portion 190.

This exemplary embodiment illustrates four of the arcuate spraying portions 195, but the number of the arcuate spraying portion 195 may be 2, 3, 5 or more.

The arcuate spraying portions 195, for example, may communicate with the connection section 184.

The arcuate spraying portions 195, for example, may communicate together by a plurality of tilt sections 182 which upwardly extend from the connection section 184 in an inclined manner.

Accordingly, the steam supplied through the single steam pipe 210 can be sprayed into each of the plurality of arcuate spraying portions 195 through the connection section 184.

Also, as illustrated in FIG. 7, a spray unit 170*c* may include a plurality of linear spraying portions 205 at the tilt section 182 of the steam spraying portion 180.

The variation exemplarily illustrates that the linear spraying portions 205 are provided by four in number and disposed at the outer side of the solution spraying portion 190 into a square shape, but this is merely illustrative. The number of the linear spraying portion 205 may be 2, 3, 5 or more.

The linear spraying portions 205 may communicate with the connection section 184. In more detail, the linear spraying portions 205 may communicate together by a plurality of tilt sections 182 which upwardly extend from the connection section 184 in an inclined manner. Accordingly, the steam introduced into the connection section 184 through the single steam pipe coupling portion 176 may be sprayed into each of the linear spraying portions 205 in a dividing manner.

Meanwhile, another end portion of the communication pipe 230, which has the one end portion communicating with the steam generator 150 or the steam pipe 210, may communicate with the solution storing container 160.

This exemplary embodiment illustrates that the communication pipe 230 communicates with the steam pipe 210, but it may alternatively be connected directly to the container 152 of the steam generator 150 so as to communicate with the inside of the steam generator 150.

Accordingly, internal pressure of the solution storing container 160 may increase upon an increase in internal pressure of the steam generator 150.

The functional solution within the solution storing container 160 may be discharged out of the solution storing container 160 through the solution pipe 220 according to a pressure difference between the internal pressure of the solution storing container 160 and external pressure of the solution storing container 160 when the internal pressure of the solution storing container 160 increases.

This may allow for excluding the use of a pump for pumping the functional solution.

The communication pipe 230, for example, may include a switching valve 240 opening and closing the communication pipe 230.

The switching valve 240, for example, may be configured to adjust an open degree.

Figure 8:
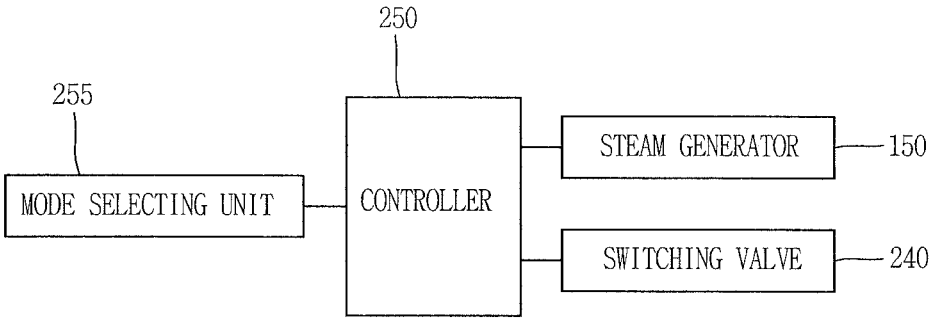
FIG. 8 is a control block diagram of FIG. 1.

Meanwhile, FIG. 8 is a control block diagram of FIG. 1.

As illustrated in FIG. 8, the clothes treating apparatus according to this embodiment may include a controller 250 having a control program for controlling the functional solution to be supplied into the accommodating space 112, if necessary.

The controller 250 may be connected with the steam generator 150 and the switching valve 240 to control each of them.

A mode selecting unit 255 for selecting a solution supply mode in which the functional solution is supplied into the accommodating space 112 may be connected to the controller 250 to input a signal to the controller 250.

The mode selecting unit 255, for example, may allow for selecting a steam supply mode in which the steam is supplied into the accommodating space 112.

With the configuration, in a state that the clothes to be treated is accommodated in the accommodating space 112 and the door 120 is closed, the solution supply mode may be selected by the mode selecting unit 255 such that the functional solution can be supplied to the clothes to be treated.

When the solution supply mode is selected, the controller 250 may control the steam generator 150 to generate steam.

The controller 250 may control the switching valve 240 to open the communication pipe 230 such that the steam generator 150 and the inside of the solution storing container 160 communicate with each other.

When the communication pipe 230 is open, the steam generated in the steam generator 150 may be introduced into the solution storing container 160 through the communication pipe 230.

Accordingly, the internal pressure of the solution storing container 160 may increase.

The steam generated in the steam generator 150 may flow into the steam spraying portion 180 along the steam pipe 210.

Figure 9:
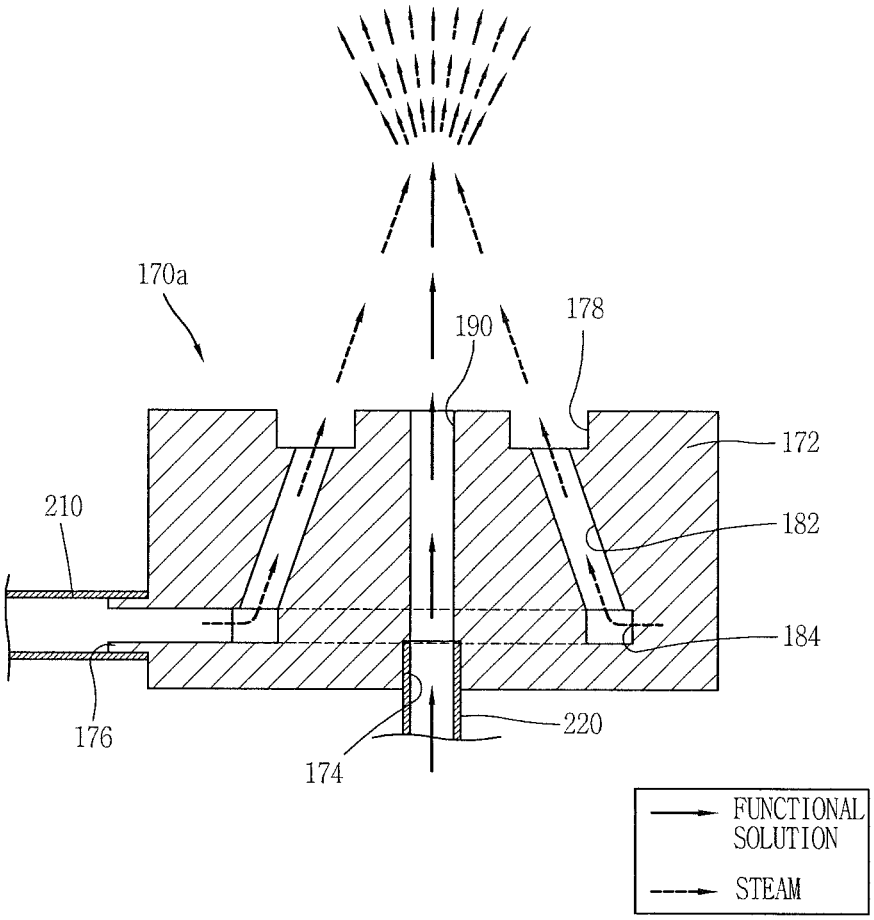
FIG. 9 is a view illustrating an operation of spraying steam and a functional solution of FIG. 3.

The steam introduced into the steam spraying portion 180, as illustrated in FIG. 9, may be sprayed through the connection section 184 and the tilt section 182.

Meanwhile, when the internal pressure of the solution storing container 160 increases due to the steam introduced into the solution storing container 160 through the communication pipe 230, the functional solution stored in the solution storing container 160 may be discharged out of the solution storing container 160 along the solution pipe 220 in a pressing manner.

The functional solution flowing along the solution pipe 220 may be sprayed through the solution spraying portion 190.

The functional solution sprayed through the solution spraying portion 190 may be atomized by colliding with the steam sprayed through the steam spraying portion 180.

Accordingly, the functional solution can be atomized before being brought into contact with the clothes to be treated, and thus mixed with the spread steam. This may allow the functional solution to be uniformly brought into contact with (sprayed on) a relatively wide area of the clothes to be treated.

This may result in preventing a generation of a portion where the functional solution and the clothes are not in contact with each other can be prevented, and facilitating realization of the purpose of using the functional solution.

Meanwhile, upon terminating the solution supply mode and/or selecting the steam supply mode, the controller 250 may control the switching valve 240 to close the communication pipe 230.

As described above, in accordance with one exemplary embodiment of the present invention, the use of a pump upon spraying a functional solution can be excluded, thereby preventing a generation of noise caused due to the pump during spraying of the functional solution.

With the exclusion of the use of the pump for spraying the functional solution, component costs for spraying the functional solution can be reduced, thereby reducing fabricating costs.

The functional solution can flow into a spraying portion by internal pressure of a steam generator and be atomized by flowing speed of steam. Thus, the atomized functional solution can be mixed with the steam and sprayed to clothes to be treated, which may allow the functional solution to be uniformly sprayed on the clothes to be treated.

As the functional solution is uniformly sprayed on the clothes to be treated, is the original purpose of the functional solution can be easily achieved.

The use of the internal pressure of the steam generator may result in an increase in a diameter of a nozzle for spraying the functional solution, which may facilitate a fabrication and processing of the nozzle.

The increase in the diameter of the nozzle for the functional solution may result in preventing the nozzle for spraying the functional solution from being blocked.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A clothes treating apparatus comprising:

a cabinet with an accommodating space that is configured to accommodate clothes to be treated;

a steam generator that is configured to generate steam;

a solution storing container that is configured to store functional solution; and a spray unit that includes:

a steam spraying portion that is configured to connect the steam generator to spray steam, and a solution spraying portion that is configured to connect to the solution storing container, and that is configured to spray the functional solution, based on the steam being sprayed through the steam spraying portion, a communication pipe that is configured to supply the steam generated by the steam generator to the solution storing container, and that includes a first end portion that is configured to communicate with the steam generator, and a second end portion that is configured to communicate with the solution storing container, wherein the spray unit is configured to allow the functional solution sprayed through the solution spraying portion to be mixed with the steam sprayed through the steam spraying portion, wherein a spraying direction of the steam through the steam spraying portion is inclined with respect to a spraying direction of the functional solution through the solution spraying portion, and wherein the solution storing container is configured to increase an internal pressure based on steam being introduced into the solution storing container through the communication pipe, and the solution in the container being sprayed through the solution spraying portion by the internal pressure formed by the steam.

2. The apparatus of claim 1, further comprising a steam pipe that is configured to connect the steam generator and the steam spraying portion to each other, wherein the communication pipe is connected to the steam pipe.

3. The apparatus of claim 1, wherein the steam spraying portion is configured to spray steam at a spraying speed at which the sprayed steam atomizes the functional solution sprayed through the solution spraying portion.

4. The apparatus of claim 1, wherein the steam spraying portion is disposed at an outer side of the solution spraying portion.

5. The apparatus of claim 4, wherein a guide is configured to protrude from an outer side of an outlet of the steam spraying portion in a spraying direction of the solution spraying portion, and that is higher than an outlet of the steam spraying portion.

6. The apparatus of claim 1, wherein the steam spraying portion has a spraying direction of the steam intersecting with a spraying direction of the functional solution of the solution spraying portion.

7. The apparatus of claim 1, wherein the spraying direction of the steam through the steam spraying portion is inclined by 40° to 60° with respect to the spraying direction of the functional solution through the solution spraying portion.

8. The apparatus of claim 1, wherein an outlet of the solution spraying portion is configured to protrude more than an outlet of the steam spraying portion along a spraying direction of the functional solution.

9. The apparatus of claim 1, wherein the steam spraying portion is configured to have an inner diameter that is larger than that of the solution spraying portion, and the steam spraying portion is concentrically disposed at an outer side of the solution spraying portion, and is configured to surround the solution spraying portion in a position spaced apart from the solution spraying portion.

10. The apparatus of claim 1, wherein the solution spraying portion has a diameter in the range of 1.5 mm to 2.5 mm.

11. The apparatus of claim 1, wherein the spray unit comprises a annular spraying portion that is configured to have an annular shape and that is concentrically disposed at an outer side of the solution spraying portion.

12. The apparatus of claim 1, wherein the spray unit comprises a plurality of arcuate spraying portions that are each configured to have an arcuate shape and disposed at an outer side of the solution spraying portion.

13. The apparatus of claim 1, wherein the spray unit comprises a plurality of linear spraying portions that are each configured to have a linear shape and disposed at an outer side of the solution spraying portion.

14. The apparatus of claim 1, further comprising:

a switching valve that is configured to open and close the communication pipe; and a controller that is configured to open the switching valve based on a solution supply mode being selected.

15. The apparatus of claim 1, further comprises a machine room provided at a lower side of the accommodating space within the cabinet, wherein an air outlet through which air is discharged and an air inlet through which air is introduced are provided at the accommodating space, and wherein the machine room includes an air supply device which is connected to the air outlet and the air inlet and by which the air within the accommodating space is discharged, processed and supplied through the air inlet.

* * * * *